US006257801B1

(12) United States Patent
Kelm et al.

(10) Patent No.: US 6,257,801 B1
(45) Date of Patent: Jul. 10, 2001

(54) RISER ARRANGEMENT FOR OFFSHORE VESSEL AND METHOD FOR INSTALLATION

(75) Inventors: Ron L. Kelm, Houston; Charles O. Etheridge, Spring; Yonghui H. Liu, Houston, all of TX (US)

(73) Assignee: FMC Corporation, Chicago, IL (US)

( * ) Notice: Subject to any disclaimer, the term of this patent is extended or adjusted under 35 U.S.C. 154(b) by 0 days.

(21) Appl. No.: 09/356,723

(22) Filed: Jul. 20, 1999

Related U.S. Application Data

(60) Provisional application No. 60/093,822, filed on Jul. 23, 1998.

(51) Int. Cl.[7] ..... B63B 22/00; F16L 1/12

(52) U.S. Cl. ..... 405/224.2; 405/195.1

(58) Field of Search ..... 405/224, 224.2, 405/224.3, 224.4, 195.1; 441/3, 4, 5, 7

(56) References Cited

U.S. PATENT DOCUMENTS

| | | | | |
|---|---|---|---|---|
| 3,226,728 | | 12/1965 | Walvoord . | |
| 3,465,374 | * | 9/1969 | Johnson et al. | 441/4 |
| 3,650,114 | | 3/1972 | Neal . | |
| 3,658,366 | | 4/1972 | Welch, Jr. et al. . | |
| 3,677,310 | * | 7/1972 | Dobler et al. | 441/4 |
| 3,724,224 | | 4/1973 | Matthews, Jr. . | |
| 3,727,954 | | 4/1973 | Oliver . | |
| 3,955,599 | | 5/1976 | Walker . | |
| 4,098,091 | | 7/1978 | Desai et al. . | |
| 4,182,584 | | 1/1980 | Panicker et al. . | |
| 4,263,004 | | 4/1981 | Joubert et al. . | |
| 4,400,110 | | 8/1983 | Beynet et al. . | |
| 4,462,717 | | 7/1984 | Falcimaigne . | |
| 4,478,586 | * | 10/1984 | Gentry et al. | 441/4 |
| 4,490,121 | * | 12/1984 | Coppens et al. | 441/5 |
| 4,523,877 | | 6/1985 | Finn et al. . | |
| 4,666,339 | | 5/1987 | Pollack . | |
| 4,673,313 | | 6/1987 | Baugh et al. . | |
| 4,702,647 | | 10/1987 | Esparza . | |
| 4,704,050 | | 11/1987 | Wallace . | |
| 4,735,267 | | 4/1988 | Stevens . | |
| 4,892,495 | * | 1/1990 | Svensen | 441/5 |
| 5,041,038 | * | 8/1991 | Poldervaart et al. | 441/5 |
| 5,269,629 | | 12/1993 | Langner . | |
| 5,275,510 | | 1/1994 | De Baan et al. . | |
| 5,316,509 | * | 5/1994 | Boatman et al. | 441/3 |
| 5,354,151 | | 10/1994 | Giannesini . | |
| 5,480,264 | | 1/1996 | Hunter . | |
| 5,639,187 | | 6/1997 | Mungall et al. . | |

FOREIGN PATENT DOCUMENTS

| | | |
|---|---|---|
| 2099894A | 12/1982 | (GB) . |
| 2153332A | 8/1985 | (GB) . |
| 2-214404(A) | 8/1990 | (JP) . |

OTHER PUBLICATIONS

Ries Uittenbogaard and Jan Pijfers; Integrated Asymmetric Mooring and Hybrid Riser System for Turret Moored Vessels in Deep Water; OTC 8441; May 5–8, 1997.

* cited by examiner

*Primary Examiner*—David Bagnell
*Assistant Examiner*—Frederick L. Lagman
(74) *Attorney, Agent, or Firm*—Gary L. Bush; Mayor, Day, Caldwell & Keeton

(57) ABSTRACT

An arrangement and method are disclosed for providing a fluid flow path between a seabed supply of hydrocarbons and a turret moored storage vessel. A steel catenary riser interface buoy provides support for a steel catenary riser and the lower end of a flexible riser. This arrangement allows both risers to be pre-installed prior to arrival of the storage vessel or other floating storage facility. A turret interface buoy, secured to an upper end of the flexible riser is used in the installation process as well as in the hook-up of the riser system to the storage vessel.

13 Claims, 3 Drawing Sheets

RISER ARRANGEMENT FOR OFFSHORE VESSEL AND METHOD FOR INSTALLATION

REFERENCE TO PREVIOUS APPLICATION

This application claims priority from Provisional Application Ser. No. 60/093,822 filed on Jul. 23, 1998.

BACKGROUND OF THE INVENTION

1. Field of the Invention

This invention relates generally to mooring arrangements for offshore floating facilities such as floating production, storage and offloading vessels (FPSO). In particular the invention relates to a riser arrangement and method for its installation by which hydrocarbon fluids from subsea wells are transferred to the vessel. Still more particularly the invention relates to a method of installing a riser system in a turret-moored vessel.

2. Description of the Prior Art

Prior riser systems have included flexible risers which extend from sea-bed wells or manifolds to the interior of a mooring turret of a FPSO for connection to a fluid swivel mounted on the turret. With deepwater subsea production systems it is advantageous to provide a rigid pipeline for connection at the seabed for connection to subsea wells and manifolds, yet a flexible riser is needed at the vessel for coupling to the turret.

U.S. Pat. No. 5,639,187 discloses a marine riser system which combines rigid (steel catenary) risers with flexible flow lines. The steel catenary risers extend from the sea floor in a gentle catenary path to a large submerged buoy positioned at a depth below the turbulence zone of the sea. Flexible risers are connected to the rigid steel risers at the submerged buoy and extend upwardly to a floating platform or vessel used as a surface production and/or storage and offloading facility.

There remains an unsolved problem of providing an arrangement and method for its installation of a combined rigid/flexible riser to a turret of a turret moored FPSO.

IDENTIFICATION OF OBJECTS OF THE INVENTION

A primary object of this invention is to provide a riser system and method for its installation for a turret moored vessel, where the riser system includes a steel catenary riser section from the sea floor and a flexible riser section coupled between the steel catenary riser section and the interior of the turret.

Another object of the invention is to provide a method of installation of a combined steel catenary riser/flexible riser system which allows both risers to be pre-installed prior to arrival of the FPSO and its coupling to the riser system.

SUMMARY OF THE INVENTION

The objects identified above as well as other advantages and features of the invention are provided for integration of steel catenary risers (SCR) for an offshore floating production storage facility with conventional flexible riser tie-ins. A Steel Catenary Riser Interface Buoy (SCRIB) is provided to couple the lower end of a flexible riser leg to the upper end of an SCR leg. The upper end of the flexible riser is supported by a Turret Interface Buoy (TIB) which is arranged and designed to be pulled up into the turret of a vessel after the vessel arrives on location and has mooring anchor legs installed.

BRIEF DESCRIPTION OF THE DRAWINGS

The objects, advantages, and features of the invention will become more apparent by reference to the drawings which are appended hereto and wherein like numerals indicate like parts and wherein an illustrative embodiment of the invention is shown, of which.

DESCRIPTION OF THE INVENTION

Figure 1:
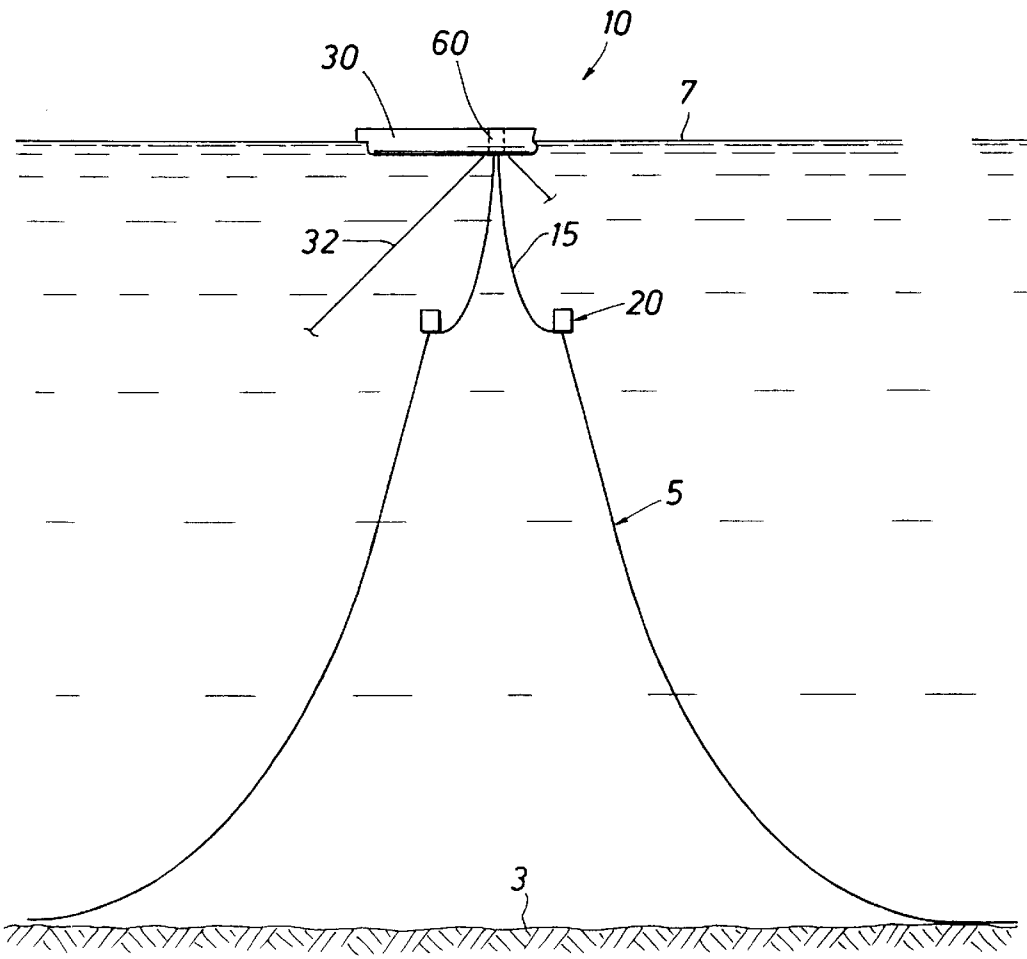
FIG. 1 schematically illustrates the riser system of the invention after installation with a floating vessel secured to the sea floor by mooring legs and with the riser system providing a fluid flow path between subsea wells/manifolds to the vessel.

FIG. 1 illustrates the riser system 10 of the invention for providing fluid flow paths between sea bed 3 wells or manifolds (not illustrated) and a turret moored floating vessel 30. The vessel 30 may be any turret moored floating facility equipped for the storage and/or production and offloading of hydrocarbons produced from subsea wells via a riser system. The riser system includes a Steel Catenary Riser (SCR) 5 and a flexible riser 15 which are coupled together at a submerged Steel Catenary Riser Interface Buoy 20 called a SCRIB. The upper end of the flexible riser is connected to a turret interface buoy (See FIGS. 5 and 6) which is secured with the turret 60 of the vessel 30. The SCRIB provides support for the SCR 5 and the lower end of the flexible riser 15. Such SCRIB and the Turret Interface Buoy (TIB) allow the SCR and the flexible riser to be pre-installed prior to the vessel (FPSO) 30 (or other floating facility) being moored on location.

The flexible riser 15 portion of the riser system can be of a catenary shape, as illustrated in FIG. 1 and subsequent figures, or any other shape using additional flotation or weight devices. For certain systems, the riser portion between the SCRIB and the TIB may include a second steel catenary riser section in lieu of the flexible riser, although flexible end joints at the SCRIB and TIB would be required.

The TIB 40 (see FIGS. 5 and 6) is used both (1) to aid in the installation process as described below) and (2) to dock the riser system 10 with the turret 60. It remains with the vessel for turret moored vessels. However the TIB can be omitted, and a smaller discardable installation buoy may be used to support the flexible riser ends prior to the arrival of the floating facility. Furthermore, with the SCRIB buoy in place, other risers can be added individually without the need of a TIB or installation buoy once the floating facility is on site.

Figure 2:
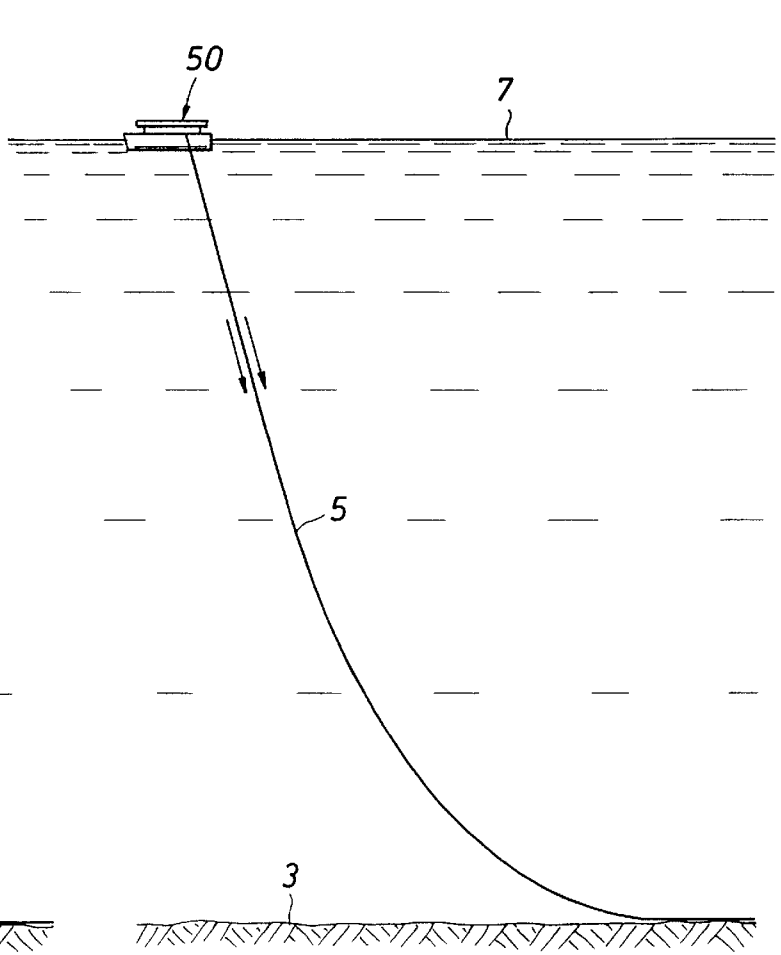
FIG. 2 illustrates the first step in the installation process by which a steel riser is deployed at the seabed by means of a conventional pipeline laying vessel.

FIG. 2 shows the first step in the installation process of the riser system of the invention. A conventional pipeline/derrick vessel 50 on the sea surface 7 lays down a rigid steel flow line 5 for termination at wells or manifolds on the sea bed 3. The steel flow line 5 has sufficient flexibility to take the shape of a catenary from its sea bed termination over a substantial distance for its connection to a flexible riser at a submerged location.

Figure 4:
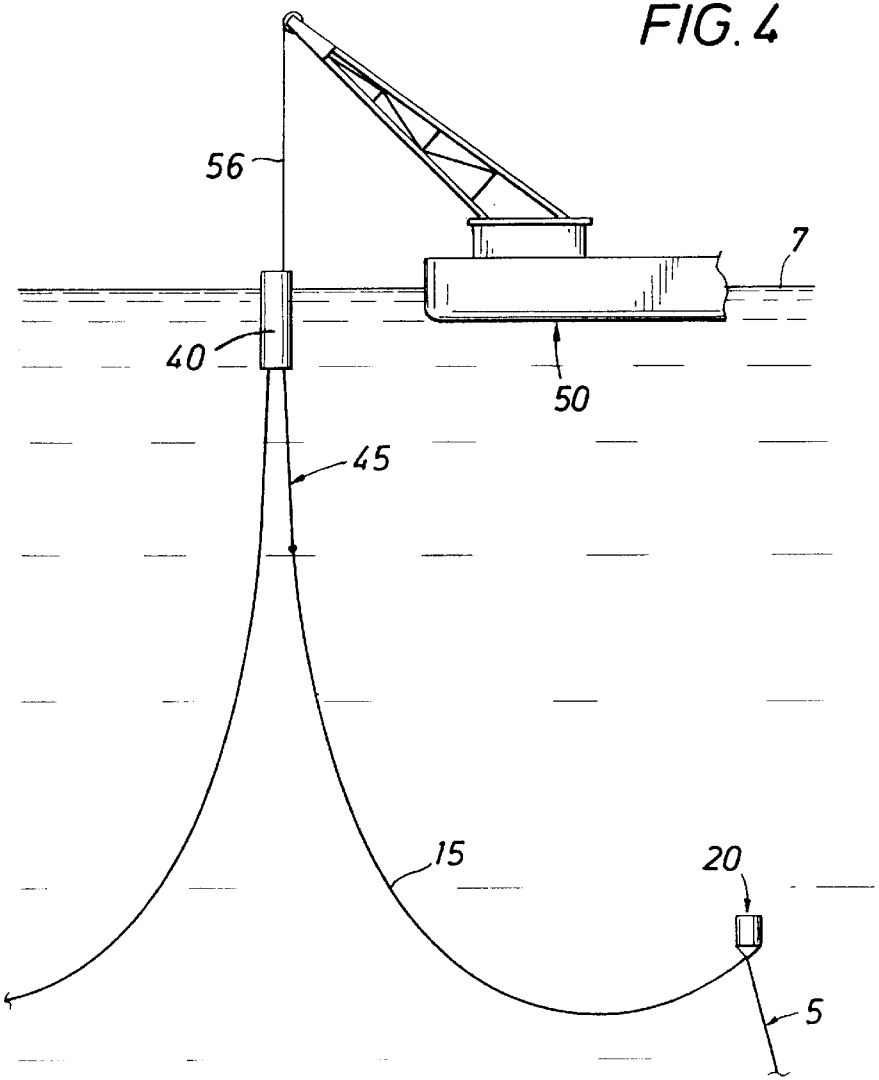
FIG. 4 illustrates a subsequent stage of the installation process of the system, where a turret interface buoy is provided which is arranged and designed to be installed with a turret of a floating vessel, and a derrick vessel installs the upper end of the flexible riser to the turret interface buoy by means of a pull-in line.
Figure 3:
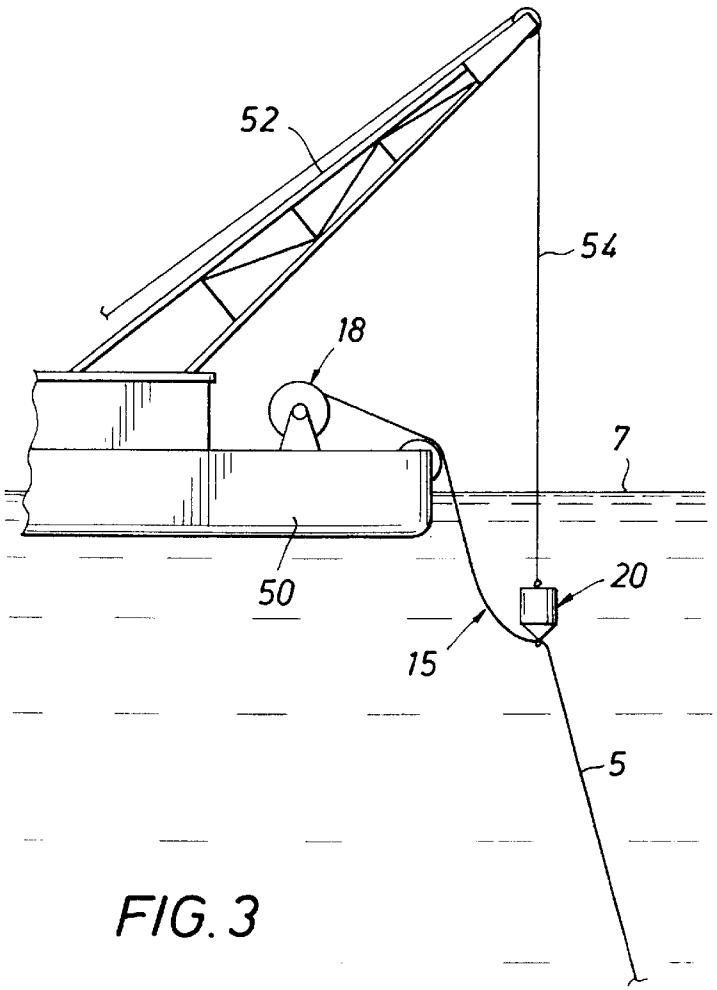
FIG. 3 illustrates a stage of the installation process of the system where a submerged interface buoy (SCRIB) is installed at the upper end of the rigid riser and shows a lower end of a flexible riser coupled thereto at the interface buoy while being payed out from a storage reel of a pipeline/derrick vessel.

FIG. 3 illustrates a next step in the installation process. A SCRIB buoy 20 is installed at the upper end of the SCR by means of a support line 54 from a derrick 52 of pipelaying/derrick vessel 50. A flexible riser section 15 is coupled to the upper end of the SCR 5 and is payed out from vessel 50 by means of a flexible riser storage reel 18. As illustrated in FIG. 3 and FIG. 4 described below, the SCRIB buoy is not tethered to the sea floor and has sufficient buoyancy to maintain the upper end of SCR 5 at a submerged position beneath sea surface 7.

FIG. 4 illustrates the next stage of the installation process where a Turret Interface Buoy (TIB) 40 is provided at the mooring location, and a pull-in line 45 is connected to the upper end of flexible riser 15 and the work line 56 of the pipelaying/derrick vessel 50. The flexible riser is pulled in for securement within the TIB 40.

Figure 5:
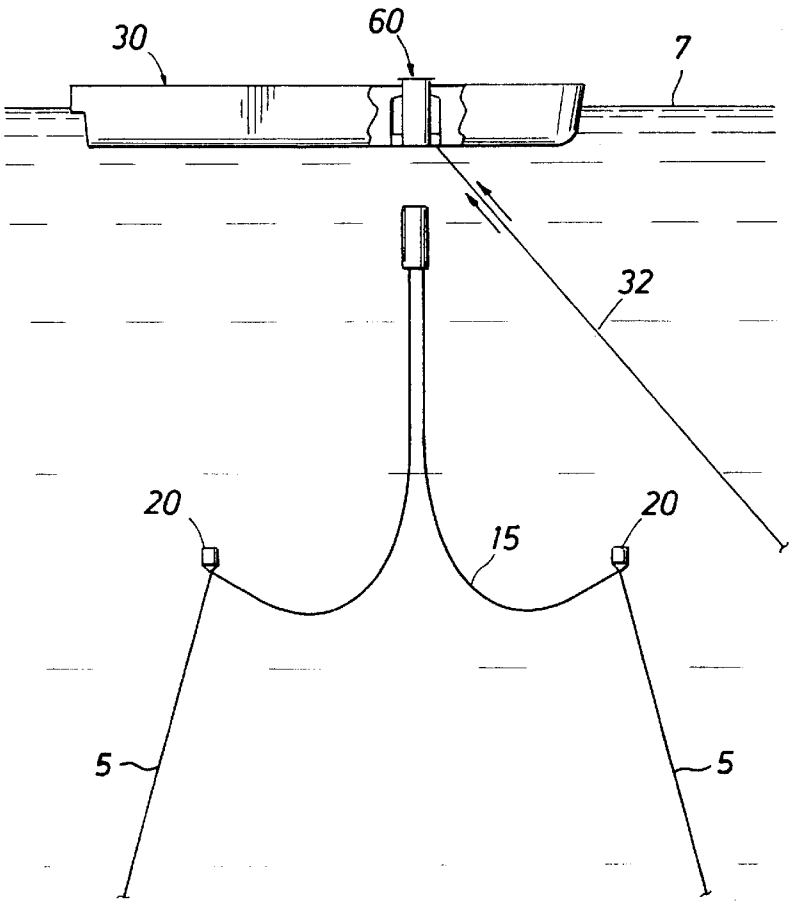
FIG. 5 illustrates another stage of the installation process where a floating vessel is positioned above the turret interface buoy, and the turret of the vessel is secured to the sea bed with mooring legs.

FIG. 5 illustrates the TIB 40 with multiple risers 5, 15 connected thereto and being supported thereby. The TIB is in a submerged position beneath the floating vessel (e.g., a FPSO) below the turret 60 of the vessel. Mooring legs 32 (only one is shown) are secured between the turret and sea bed anchors in a conventional manner. The mooring legs 32 provide a substantially non-rotative mooring for the turret. The floating facility includes bearings which couple the turret with the vessel so that the vessel is capable of weathervaning about the turret.

Figure 6:
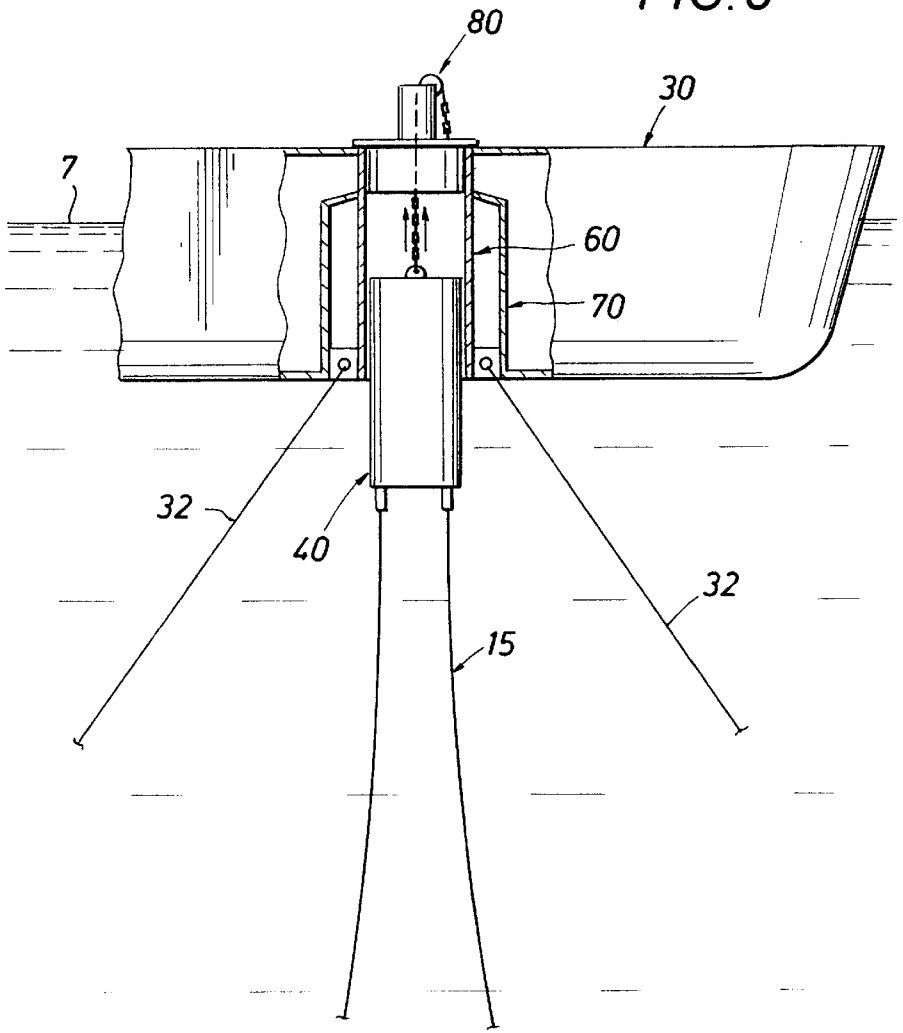
FIG. 6 illustrates a final stage of the installation process where the turret interface buoy, with the risers connected thereto, is pulled into the interior of the turret by pull-in equipment of the vessel.

FIG. 6 illustrates a final stage of the installation process of connecting the risers to the floating facility 30. A TIB pull-in arrangement 80 is mounted on the turret for pulling the TIB 40 up into securement within the interior of the turret 60. FIG. 6 illustrates that turret 60 is mounted within moon pool 70 and that the mooring legs 32 are secured to the turret 60 for securement thereto. Rotative fluid couplings (swivels) are provided on the top of the turret in a conventional fashion for providing a rotative fluid flow path from each riser to a storage hold in the vessel.

After the TIB 40 is secured within turret 60, additional risers can be added individually without the need for the TIB or a disposable installation buoy.

What is claimed is:

1. A riser arrangement for a turret moored floating facility, the arrangement providing a fluid flow path between a sea bed and a turret of the floating facility in the sea and comprising, a first riser having a first end which extends from a seabed hydrocarbon supply location and a second end which extends to a submerged depth position in the sea, said first riser being a rigid tubular pipeline having a catenary shape between said seabed hydrocarbon supply and said submerged depth position, a second riser coupled at one end to said second end of said first riser to form a fluid flow path from said seabed hydrocarbon supply to an opposite end of said second riser, said second riser being a flexible hose, a submerged SCR interface buoy which is not tethered to said seabed, said SCR interface buoy being positioned at said submerged depth position which supports said first and second risers at said submerged depth positions, and a turret interface buoy coupled to said opposite end of said second riser, said turret interface buoy being designed and arranged to support said opposite end of said second riser at a submerged position beneath said floating facility and for coupling to said turret of said floating facility.

2. The riser arrangement of claim 1 wherein, said turret interface buoy is arranged and designed to dock inside said turret for coupling of said second riser to said floating facility, thereby providing a fluid flow path between said seabed and said floating facility in the sea.

3. A riser arrangement for a turret moored floating facility, the arrangement providing a fluid flow path between a sea bed and the floating facility in the sea and comprising, a first riser having a first end which extends from a seabed hydrocarbon supply location and a second end which extends to a submerged depth position in the sea, said first riser having a catenary shape between said seabed hydrocarbon supply and said submerged depth position, a second riser coupled at one end to said second end of said first riser to form a fluid flow path from said seabed hydrocarbon supply to an opposite end of said second riser, a submerged SCR interface buoy positioned at said submerged depth position which supports said first and second risers at said submerged depth positions, a turret interface buoy coupled to said opposite end of said second riser, said turret interface buoy being designed and arranged to support said opposite end of said second riser at a submerged position beneath said floating facility and for coupling to said turret of said floating facility, and wherein, said first riser is a rigid tubular pipeline of a length and flexibility to assume said catenary shape between said seabed hydrocarbon supply location and said submerged depth position, and said second riser is a second steel tubular pipeline of a length and flexibility to assume a catenary shape between said second end of said first riser and said turret interface buoy, and further comprising a first flexible end joint disposed at said one end of said second riser to said second end of said first riser and a second flexible end joint which connects said opposite end of said second riser to said turret interface buoy.

4. A method for installing a riser system between a seabed and a turret moored vessel comprising of the steps of, laying down a rigid tubular pipeline (5) for termination at a hydrocarbon supply on said seabed, said pipeline having sufficient flexibility to take the shape of a catenary from a lower end of said pipeline at said seabed to an upper end of said pipeline at a submerged location, installing a SCR interface buoy (20) without a tether from said seabed at said submerged location to support said upper end of said pipeline, coupling a lower end of a flexible riser (15) to said upper end of said pipeline, where said flexible riser is a hose, providing a turret interface buoy (40) at a mooring location, securing an upper end of said flexible riser (15) to said turret interface buoy (40), and coupling said turret interface buoy to a turret (60) of said turret moored vessel.

5. The method of claim 4 wherein, said laying down step is performed by a pipeline vessel (50).

6. The method of claim 4 wherein, said installing a SCR interface buoy step includes the step of attaching a support line (54) between said SCR interface buoy (20) and a derrick support vessel (52), and said coupling of said lower end of a flexible riser to said upper end of said pipeline step includes the step of paying out said flexible riser (15) from said support vessel (50).

7. The method of claim 4 wherein, said securing step includes the steps of providing a pull-in line (56) via said turret interface buoy (40), connecting an end of said pull-in line (56) to an upper end of said flexible riser (15), and pulling said upper end of said flexible riser upward for securement within said turret interface buoy (40).

8. The method of claim 4 wherein, said coupling of said turret interface buoy (40) to a turret (60) step includes the step of pulling said turret interface buoy (40) within the interior of said turret (60).

9. The method of claim 4 further comprising, installing an additional riser from said hydrocarbon supply on said seabed via said SCR interface buoy directly to said turret interface buoy.

10. A riser arrangement for a moored floating facility, the arrangement providing a fluid flow path between a seabed and a position beneath the sea surface and comprising, a first riser having a first end which extends from a seabed hydrocarbon supply location and a second end which extends to a submerged depth position in the sea, said first riser being a rigid pipeline and having a catenary shape between said seabed hydrocarbon supply and said submerged depth position, a second riser coupled at one end to said second end of said first riser to form a fluid flow path from said seabed hydrocarbon supply to an opposite end of said second riser, said second riser being a flexible hose, a submerged SCR interface buoy positioned at said submerged depth position which supports said first and second risers at said submerged depth positions, and a discardable installation buoy coupled to said second end of said second riser, said discardable installation buoy being designed and arranged to support said opposite end of said second riser at a submerged position beneath said floating facility and to be discarded after said opposite end of said second riser is coupled to said floating facility.

11. A riser arrangement for a turret moored floating facility, the arrangement providing at least two riser fluid flow paths between a sea bed and the floating facility in the sea comprising:

a first riser fluid flow path including a first riser having a first end which extends from a first seabed hydrocarbon supply location and a second end which extends to a first submerged depth position in the sea, said first riser being a first rigid pipeline and having a catenary shape between said first seabed hydrocarbon supply and said first submerged depth position, a second riser coupled at one end to said second end of said first riser to form said first fluid flow path from said seabed hydrocarbon supply to an opposite end of said second riser, said second riser being a first flexible hose;

a first submerged SCR interface buoy positioned at said first submerged depth position which supports said first and second risers at said first submerged depth position, a second riser fluid flow path including a third riser having a first end which extends from a second seabed hydrocarbon supply location and a second end which extends to a second submerged depth position in the sea, said third riser being a second rigid pipeline and having a catenary shape between said second seabed hydrocarbon supply and said second seabed depth position, a fourth riser coupled at one end to said second end of said third riser to form said second riser fluid flow path from said second seabed hydrocarbon supply location to an opposite end of said fourth riser, said fourth riser being a second flexible hose;

a second submerged SCR interface buoy positioned at said second submerged depth position which supports said third and fourth riser at said second submerged depth position, and a turret interface buoy coupled to said opposite ends of said second riser and said fourth riser, said turret interface buoy being designed and arranged to support said opposite ends of said second and fourth risers at a submerged position beneath said floating facility and for coupling to said turret of said floating facility.

12. The riser arrangement of claim 11 wherein, said first and second submerged SCR interface buoys are not tethered to said seabed.

13. The riser arrangement of claim 11 wherein, said turret interface buoy is arranged and designed to dock with said turret for coupling said second and fourth risers to said floating facility, thereby providing a fluid flow path between said seabed and said floating facility in the sea.

* * * * *